US008402613B2

(12) United States Patent
Williams et al.

(10) Patent No.: US 8,402,613 B2
(45) Date of Patent: Mar. 26, 2013

(54) SLIDE FASTENER

(75) Inventors: Meirion Williams, Cheshire (GB); Mark Davies, Cheshire (GB)

(73) Assignee: YKK Corporation (JP)

( * ) Notice: Subject to any disclaimer, the term of this patent is extended or adjusted under 35 U.S.C. 154(b) by 211 days.

(21) Appl. No.: 12/949,155

(22) Filed: Nov. 18, 2010

(65) Prior Publication Data

US 2011/0113596 A1 May 19, 2011

(30) Foreign Application Priority Data

Nov. 18, 2009 (GB) ..... 0920212.8

(51) Int. Cl.
*A44B 19/32* (2006.01)
*A44B 19/36* (2006.01)

(52) U.S. Cl. ..... 24/389; 24/435

(58) Field of Classification Search ..... 24/433, 24/434, 435, 387, 388, 384, 389
See application file for complete search history.

(56) References Cited

U.S. PATENT DOCUMENTS

| | | | | |
|---|---|---|---|---|
| 3,616,939 | A | 11/1971 | Potin | |
| 3,857,141 | A * | 12/1974 | Ebata | 24/435 |
| 3,924,305 | A | 12/1975 | Hamamura | |
| 4,091,509 | A | 5/1978 | MacFee | |
| 7,231,697 | B2 * | 6/2007 | Takamatsu et al. | 24/436 |
| 7,251,866 | B2 * | 8/2007 | Himi | 24/435 |

FOREIGN PATENT DOCUMENTS

| | | | |
|---|---|---|---|
| EP | 0345799 | A1 | 12/1989 |
| EP | 1057423 | A1 | 12/2000 |
| EP | 1175842 | A2 | 1/2002 |
| EP | 1321062 | A2 | 6/2003 |
| EP | 1543739 | A2 | 6/2005 |
| EP | 1772071 | A1 | 4/2007 |
| EP | 1964486 | A1 | 9/2008 |
| GB | 1024733 | | 4/1966 |
| GB | 1270179 | | 4/1972 |
| JP | 63-028887 | | 8/1988 |

* cited by examiner

*Primary Examiner* — James Brittain
(74) *Attorney, Agent, or Firm* — Kilpatrick Townsend & Stockton LLP

(57) ABSTRACT

A slide fastener is provided. A pair of coupling elements provided along adjacent edges of a pair of fastener tapes. A slider is configured to engage or separate the pair of coupling elements with or from each other. An end stop is secured to the pair of fastener tapes at an end portion of the pair of coupling elements. The pair of coupling elements are secured to each other at one region of the end portion of the pair of coupling elements. The one region extends between a rear end portion of a diamond of the slider and a base portion of the slider in a state where the base portion of the slider comes in contact with the end stop.

12 Claims, 12 Drawing Sheets

SLIDE FASTENER

The disclosure of UK Patent Application No. 0920212.8 filed on Nov. 18, 2009, including specification, drawings and claims are incorporated herein by reference in their entirety.

BACKGROUND

The present invention relates to a slide fastener or a zip fastener with an end stop. Whilst the present invention finds particular application for use with slide fasteners having coupling elements, it can be used with fasteners having metallic coupling elements which are crimped in place on the fastener tape edges, but is preferably used with moulded or formed elements. The slide fastener and the end stop of the present invention is more preferably used with plastics coupling elements.

One of the rare drawbacks of using modern day slide fasteners or zip fasteners is that the chain formed by the interdigitation of the couplings elements on almost any slide fasteners can be broken by folding the slide fastener back on itself and applying enough pressure or, pushing on the interlocking coupling elements with enough force so that the interdigitation or coupling of the coupling elements is broken. In most cases this is a very rare event but when it does occur for example by the use of excessive force, the product into which the slide fastener has been attached will in effect become useless.

One method which is often employed to restore the slide fastener broken in this manner is to try and force a slider present on the slide fastener over the coupling elements which have been forced open, to the start position of the slide fastener, and then pull the slider up again in an attempt to force the erroneously opened coupling elements into a cooperating arrangement again. On an open ended slide fastener (that is, a slide fastener wherein the two tapes are joined together by using a separable bottom stop), this is a relatively straight forward procedure because the slider can be returned to the start position. For a closed end slide fastener (this is where the bottom end of the chain has joined tapes) the slider can be returned to the start position at the bottom of the slide fastener but this approach is not sufficient. The reason for this is that when using a slide fastener the coupling elements need to pass around the diamond present in the centre of the slider in order to be presented at the correct angle for closure. Therefore, a diamond of the slider needs to start from a position below the open coupling elements.

However, the diamond can never move below the rear portion of the slider because it is fixed towards the front portion of the slider. Further, in a closed end slide fastener, the bottom of the slider can never go below the bottom stop because if it did so the slider would fall off the slide fastener. As a result, even when the slider is at the bottom of the slide fastener there will always be coupling elements which will remain separated once the chain has burst thereby preventing the complete re-closure of all of the coupling elements on the slide fastener. This situation is obviously unsatisfactory for slide fasteners used in a range of applications. The present invention therefore seeks to address this problem, by means of an improved end stop, most preferably an improved bottom end stop.

Whilst not limited thereto, one situation where the present invention is particularly useful is with slide fasteners having a thermoplastics coating layer such as some concealed fasteners or with fluid tight slide fasteners as described in EP-A-1057423 and EP-A-1175842. In these arrangements, the natural or synthetic rubber of thermoplastic coating layers or waterproof layers applied on one surface of the fastener tapes abut one another above the plane of the coupling elements to form a seal which prevents infiltration of water. Consequently, for fasteners with thermoplastics coating layers creating watertight seals as described above, the problem of fasteners with coupling elements which are forced apart renders the articles into which the slide fastener has been applied useless.

The present invention therefore also seeks to overcome any problems associated with waterproof slide fasteners for the slide fasteners with closed end stop, in which the coupling elements have become disengaged. However, the present invention primarily seeks to address the problem of slide fasteners in which some or all of the coupling elements have burst open and it is desired to re-interdigitate all of the coupling coupling elements in the slide fastener.

Various methods exist for forming closed end stops on slide fasteners. Closed end stops are end stops which bridge the fastener tapes to secure the two tapes together as well as arrest the travel of the slider. Most often a closed end stop is used at the bottom end (a lower side) of a fastener, but there are occasions when such an end stop is also used at the top end in a slide fastener in which one or more sliders are used. However, the aim of the bottom end stop (or top end) is to prevent a slider from coming off the slide fastener when t slider is reciprocally moved thereon to open and close the coupling elements and hence the slide fastener.

Typically a most basic end stop is formed by crimping a metal staple or crimp on to the fastener tapes or tapes. For a bottom end stop, the metal staple or crimp may be provided to bridge the two tapes of the slide fastener to hold them together and thereby prevent a slider present from coming off the slide fastener.

In EP 1,964,486 there is disclosed an end stop for use with waterproof slide fasteners comprising a pair of tapes and coupling elements along adjacent edges of the tapes wherein the tapes are partly cut away to form a gap into which an end stop is moulded and which extends along the tape edges and away from the coupling elements.

In U.S. Pat. No. 3,924,305, strips (pieces of fabric) are fastened across the end of the fastener chain, below the closed bottom end stop, to provide reinforcement and in JP-UM-63-28887 an end stop is formed by welding a strip on to a group of coil type coupling elements.

With continuous coil type coupling elements, there have been many attempts to utilise the coupling elements themselves to form an end stop. These attempts have typically involved melting the coupling elements, such as described in GB-A-1270179 to fuse opposed coupling elements in coupled disposition (for a bottom end stop) or to fuse adjacent coupling elements at their upper ends on a tape edge (to form a top end stop). However, this approach has typically resulted in unsatisfaction for the end stop or the coil-shaped coupling elements because it is elaborate or time consuming processes.

In U.S. Pat. No. 4,091,509 there is described a slide fastener with a bottom end stop in which an elongated member is inserted through the coinciding central openings of interlocking coils at the bottom of the slide fastener and which is then secured in place by deforming one or more of the convolutions of the coils at the bottom of the slide fastener.

In EP 1,543,739 there is described an end stop for a slide fastener which includes a rod-like body and coupling heads of coupling elements, both of which are comprised of synthetic resin. The slide fastener is formed by selectively fusing together the rod-like body and the coupling heads of the coupling elements on the slide fastener once the rod-like body has been inserted into the space created by the coupling heads.

In GB 1,024,733, EP 1,772,071, EP 0,345,799, EP 1321062, and U.S. Pat. No. 3,616,939 there are again disclosed various forms of slide fasteners with end stops in combination with water proofing properties, however, none of these documents address the problem of the present invention which provides an end stop for a slide fastener in which the bottom couplings elements are so joined to ensure that there can never be any coupling elements which may remain disengaged even when the chain of the slide fastener has been broken.

SUMMARY

In accordance with the present invention it has now been found possible to form a closed end stop by welding together a length of the coupling elements on the opposed coupling tapes by means of for example injection moulding. The coupling elements may alternatively and/or additionally be welded together prior to being injection moulded into a coupling relationship. The coupling elements may also be sewn together prior to being welded and/or injection moulded together. When present, the facing edges or sealing lips of thermoplastic waterproof layers coating the fastener tapes can also be welded or sealed together in the region of the fused or injection moulded coupling elements. This combination of process steps enhances the strength of the end stop and provides a smooth surface on both sides of the fastener and can also be used to enhance the fluid tightness below the end stop for use for example with waterproof slide fastener arrangements. However, regardless of whether a thermoplastic waterproof layer is present or not, the present invention addresses the problem associated with coupling elements remaining open when the chain of the slide fastener has burst.

In addition, when the coupling elements are joined by injection moulding an end stop onto the tapes, this provides a better visual indication of a position of the end stop and can also enhance the resistance to separation of the tapes at the position of the end stop.

Furthermore, the presence of injection moulded plastic material on the coupling elements and/or welded coupling elements or on a gapped chain immediately below the coupling elements provides an extended end stop upon the front portion of which will rest a base portion of a slider as it passes onto the moulded and/or welded coupling elements such that there is never a region of the coupling elements that can not be re-interdigitated if the chain of the coupling elements is broken.

It is therefore an object of at least one aspect of embodiments of the present invention to provide a slide fastener capable of re-interdigitate all of coupling elements some or all of which have been opened, even when the slide fastener has a closed end stop.

According to an aspect of the embodiments of the present invention, there is provided a slide fastener, comprising: a pair of fastener tapes; a pair of coupling elements provided along adjacent edges of the pair of fastener tapes; a slider that engages or separates the pair of coupling elements with or from each other; and an end stop secured to the pair of fastener tapes at an end portion of the pair of coupling elements, wherein the pair of coupling elements are secured to each other at one region of the end portion of the pair of coupling elements, and wherein the one region extends between a rear end portion of a diamond of the slider and a base portion of the slider in a state where the base portion of the slider comes in contact with the end stop.

The pair of coupling elements can be secured by means of injection moulding. Alternatively, the pair of coupling elements can be secured by means of sewing. In addition, the pair of coupling elements can be secured by means of welding or melting. In a preferred embodiment of the present invention however the coupling elements are secured by melting or welding and also by injection moulding a suitable material over the coupling elements.

The fastener tapes and the coupling elements of the slide fastener may be joined by an extension portion of the end stop between the adjacent edges of the fastener tapes.

It is also preferred that each of the pair of coupling elements of the slide fastener are formed by a continuous coil.

The end stop may be a closed end stop and may be provided to cover the adjacent edges of the pair of fastener tapes.

In the slide fastener according to the embodiments of the present invention, the end stop may include a body portion which is formed on a tape surface of at least one side of the pair of fastener tapes.

In addition, in a further preferred embodiment, the slide fastener may be a waterproof slide fastener, the pair of fastener tapes may include waterproof layers on one side or both sides of the tape layers of the pair of fastener tapes, and the waterproof layers may be abut one another In a preferred embodiment of the present invention, the abutting waterproof layers are further melted to improve the waterproof seal.

It is also preferred that the end stop extends over an adjacent area of the waterproof layers. Furthermore, the end stop preferably protrudes toward an opposite side of the body portion with respect to the coupling elements and extends to an end portion of the fastener tapes.

Furthermore, in the slide fastener of the embodiments of the present invention, the end stop preferably includes a cob protruding from the end stop in a direction of a chain of the coupling elements against which the base portion of the slider abuts. The cob is preferably also comprised of plastics material and is so sized to stop the slider going past the cob whilst maintaining a design to allow the slider to abut against it.

Other preferred features and aspects of the invention will be apparent from the following description and the accompanying claims.

In the slide fastener according to an aspect of embodiments of the present invention, since the pair of coupling elements are secured at one region of an end portion of the pair of coupling elements and the one region extends between a rear end portion of a diamond of the slider and a base portion of the slider in a state where the base portion of the slider comes in contact with the end stop, it is possible to re-interdigitate all of coupling elements some or all of which have been opened, even when the slide fastener has a closed end stop.

BRIEF DESCRIPTION OF DRAWINGS

The invention will be further described by way of example with reference to the accompanying drawings, in which.

DETAILED DESCRIPTION OF EMBODIMENTS

Figure 1:
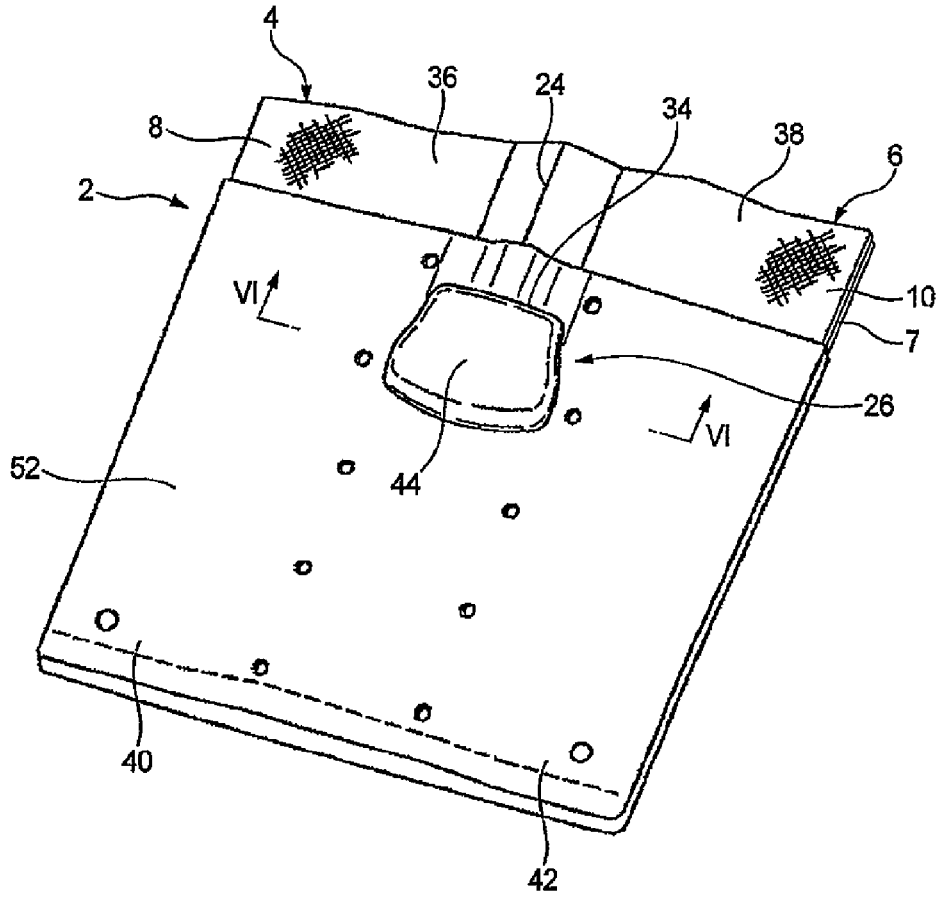
FIG. 1 is a top view of a waterproof slide fastener.
Figure 2:
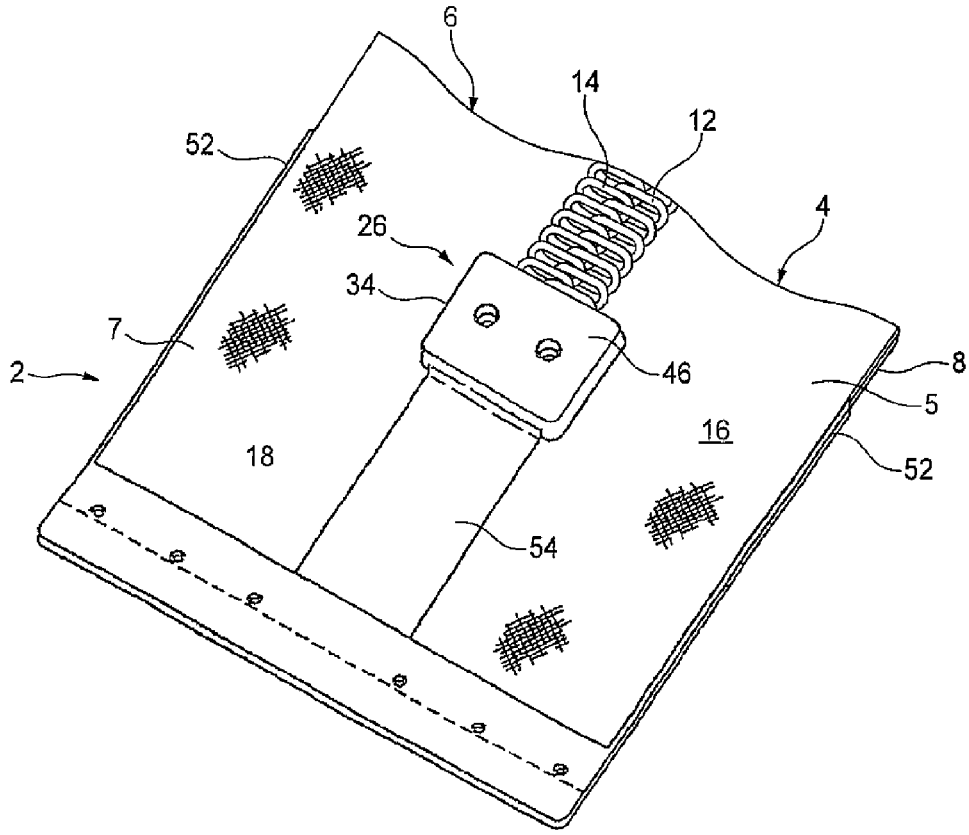
FIG. 2 is an underneath view of the slide fastener of FIG. 1.
Figure 3:
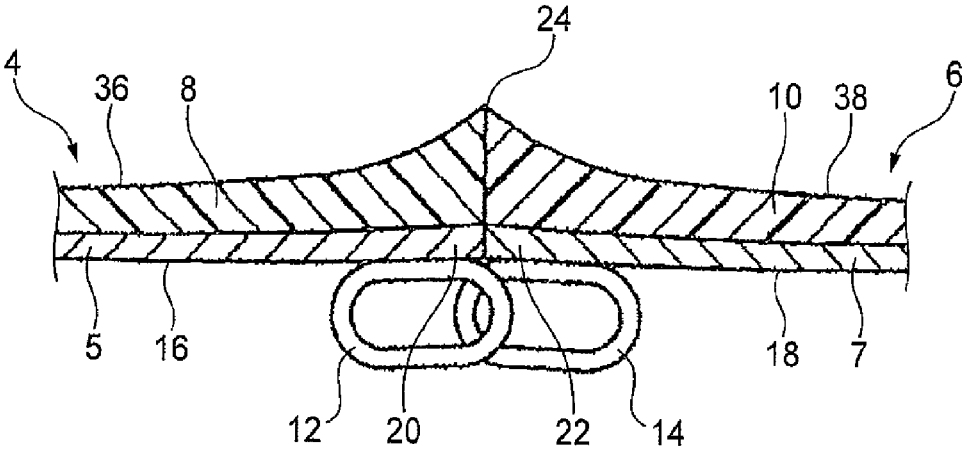
FIG. 3 shows a cross-sectional view taking along the line V-V of FIG. 5.

In FIGS. 1 and 2, there is shown a slide fastener, more particularly a waterproof slide fastener 2 of the general type seen in EP-A-1057423 and incorporated herein by reference. The slide fastener 2 comprises a pair of fastener tapes 4, 6 (hereinafter, also referred to as "tapes"), having a tape layer 5, 7 and made from knitted or woven material such as for example polyester. Coupling elements 12, 14 are sewn onto the underneath surfaces 16, 18 of the tapes layers 5, 7 at their adjacent edges 20, 22 (adjacent edge portions of the pair of fastener tapes 4, 6) as well known in the art. The coupling elements 12, 14 are also referred to as coil fastener elements in which each monofilament is formed into a coil shape to form a continuous coil and head portions (which are formed into bulged shape) for the interdigitation are formed in each of the coil-shaped coupling elements 12, 14. The coupling elements 12, 14 may be woven or knitted into the fastener tapes 4, 6 as the fastener tapes 4, 6 are formed or sewn in afterwards. A waterproof layers 8, 10 comprised of for example waterproof thermoplastic elastomeric material such as polyurethane, is provided on the upper surface of the tape layers 5, 7. The materials of the tape layers 5, 7 and the waterproof layers 8, 10 are preferably compatible so as to form a bond easily to one another. That is, the term "compatible" used herein means the nature of being easily bonded to one another. In this embodiment, the fastener tapes 4, 6 includes the tape layers 5, 7 and the waterproof layers 8, 10, but the fastener tapes 4, 6 may includes the tape layers 5, 7 without including the waterproof layers 8, 10.

Figure 12:
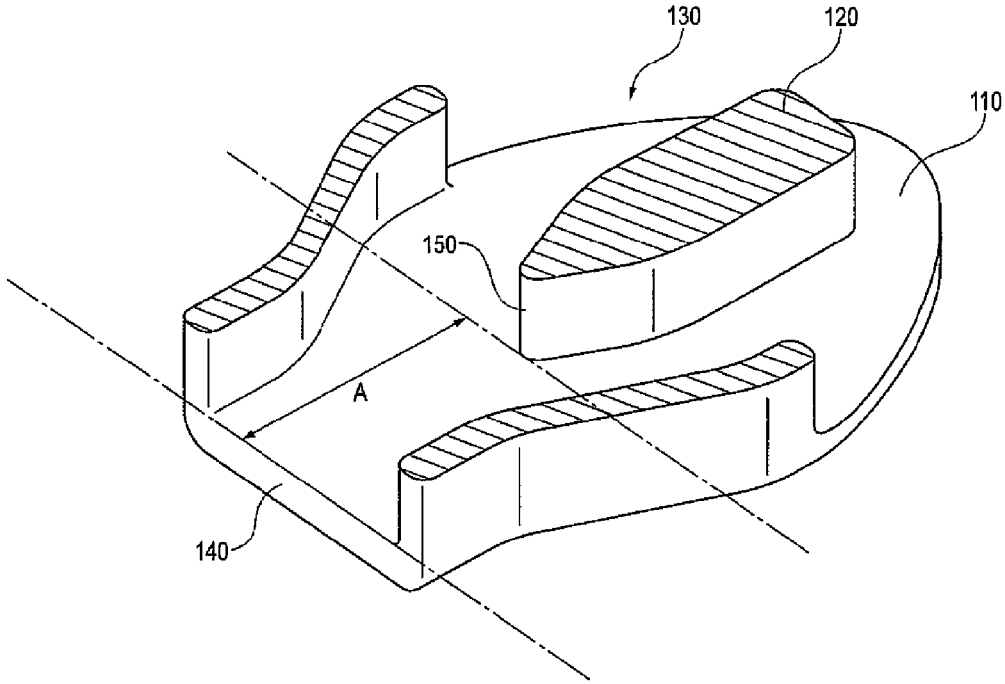
FIG. 12 shows a partially cross-sectional perspective view of a slider with a diamond exposed.
Figure 13:
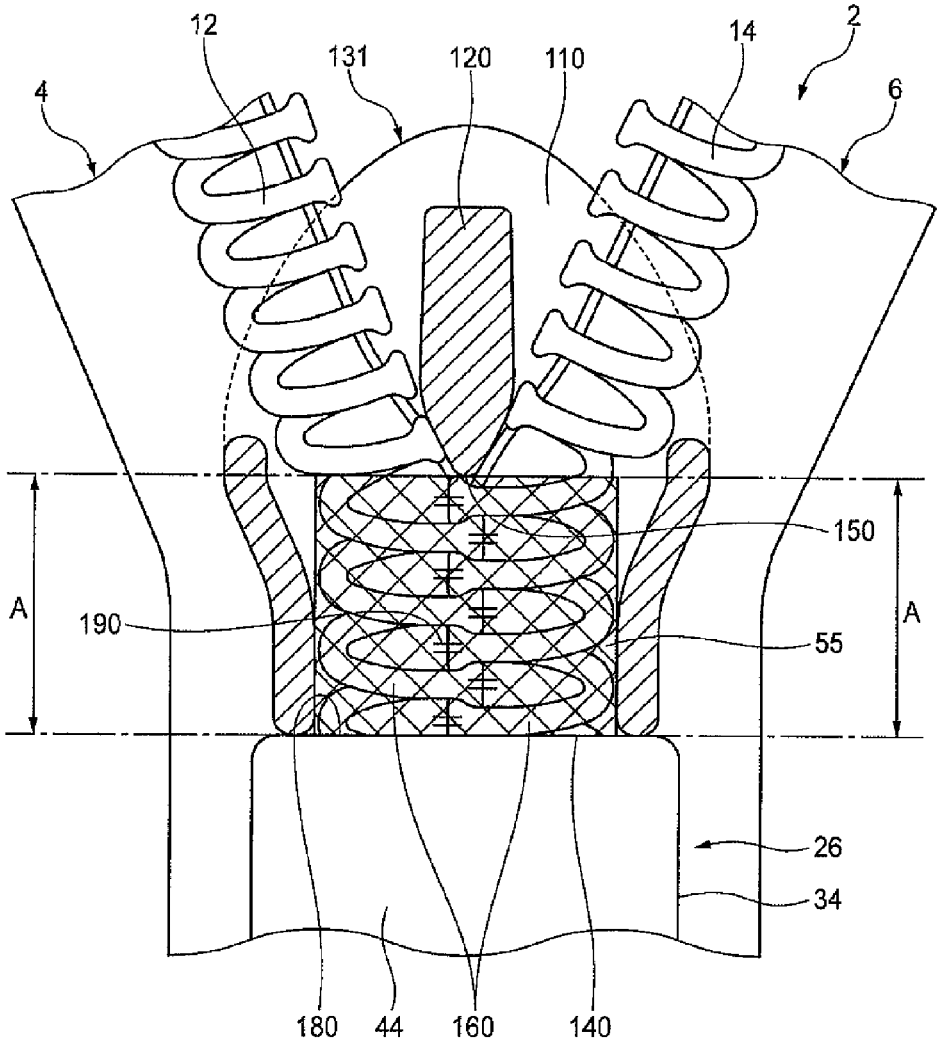
FIG. 13 shows an enlarged plan view of a portion of a slide fastener with the coupling elements welded by an amount indicated by region A below a rear end of the diamond.

In accordance with known slide fasteners, the coupling elements 12, 14 are engaged with or separated from each other by reciprocal movement of sliders 130, 131 (refer to FIGS. 12, 13). In the reciprocal movement of the slider 130, 131, a moving direction of the sliders 130, 131 for engaging the coupling elements 12, 14 with each other is referred to as a front (forward) of the slider, and a moving direction of the slider 130, 131 for separating the coupling elements 12, 14 from each other, which is opposite to the front, is referred to as a rear (backward) of the slider. Sliders 130, 131 typically comprise an upper wing 100 (refer to FIG. 10) and a lower wing 110, which are connected by a guide post or a diamond 120, which is a typical structure of a slider. The diamond 120 is disposed at the front side of the upper and lower wings 100, 110 of the sliders 130, 131. Front ends of the upper and lower wings 100, 110 are referred to as a shoulder mouth and rear ends of the upper and lower wings 100, 110 are referred to as a base portion 140 (or a rear mouth) of the slider. However, sliders 130, 131 are not necessarily limited to this typical structure and it will be appreciated that the present invention is not limited to this form of slider. For example the position of the diamond or guide post can be moved and the shape altered depending upon the nature of the slider and the type of slide fastener it is required to close. Of importance to the present invention however is the relationship between the diamond 120 which is shown in FIGS. 12 and 13 and the welded coupling elements 12, 14 (160) denoted by region A in FIGS. 9 and 13.

FIGS. 1 and 2 show a moulded bottom end stop indicated generally by the reference numeral 26. The formation of the end stop 26 in one embodiment of the present invention will now be described with reference to FIGS. 5 and 6 which show the slide fastener 2 prior to formation of the end stop 26.

In the form of the end stop 26 shown in FIGS. 1 and 2, the end stop 26 is moulded of a plastics material. The end stop 26 may be moulded of thermoplastic elastomeric material as well as the waterproof layers 8, 10. End stop 26 has a body portion 34 having an upper part 44 and a lower part 46. Upper and lower parts 44, 46 may extend above and/or below the tape layers 5, 7 and the waterproof layers 8, 10, respectively. The end stop 26 bridges the pair of tape layers 5, 7 and is formed at a rear end portion of arrays of coupling elements 12, 14.

The body portion 34 so formed serves to prevent the sliders 130, 131 from coming off the coupling elements 12, 14 during the sliders 130, 131 are reciprocally moved along the coupling elements 12, 14 for coupling (engaging) or decoupling (separating) the coupling elements 12, 14.

Figure 4:
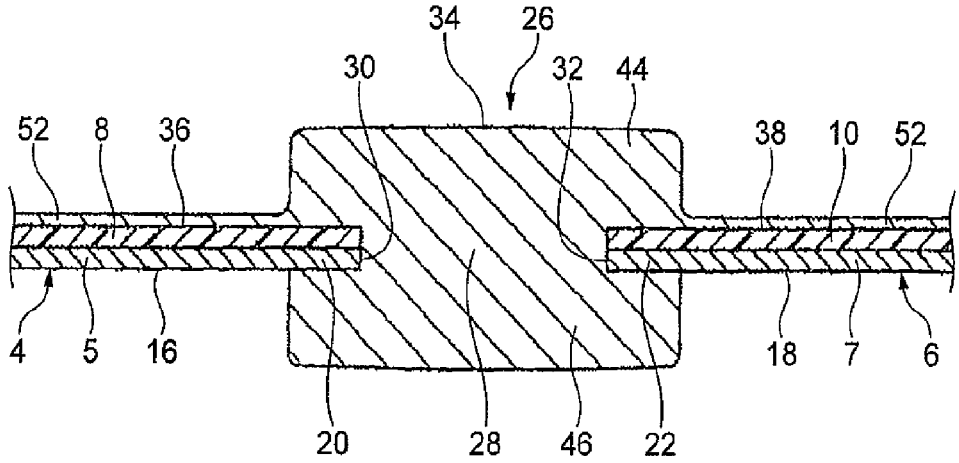
FIG. 4 shows a cross-sectional view taking along the line VI-VI of FIG. 1.

As shown in FIG. 4, in one embodiment of the present invention, the body portion 34 may fill any gap 28 between the opposed (adjacent) edges 30, 32 of the tapes 4, 6 when the end stop 26 is attached between the opposed edges 30, 32 of the tapes 4, 6. Body portion 34 also overlaps the tape edges 30, 32 to bear on and bond to the underneath surfaces 16, 18 of the fastener tapes (fabric layers) 4, 6 and the upper surfaces 36, 38 of the waterproof layers 8, 10. An extension portion 54 (an extended end stop) of the end stop 26, which extends from the body portion 34 is formed so as to extend from the body portion 34 along the tape layers 5, 7 in a rear (backward) direction of the slide fastener 2 (toward an opposite side to a side at which the coupling elements 12, 14 are formed) and fills a gap between the pair of tape layers 5, 7. The extended end stop 54 is lower than the body portion 34 in height (thinner than the body portion 34 in thickness).

Figure 5:
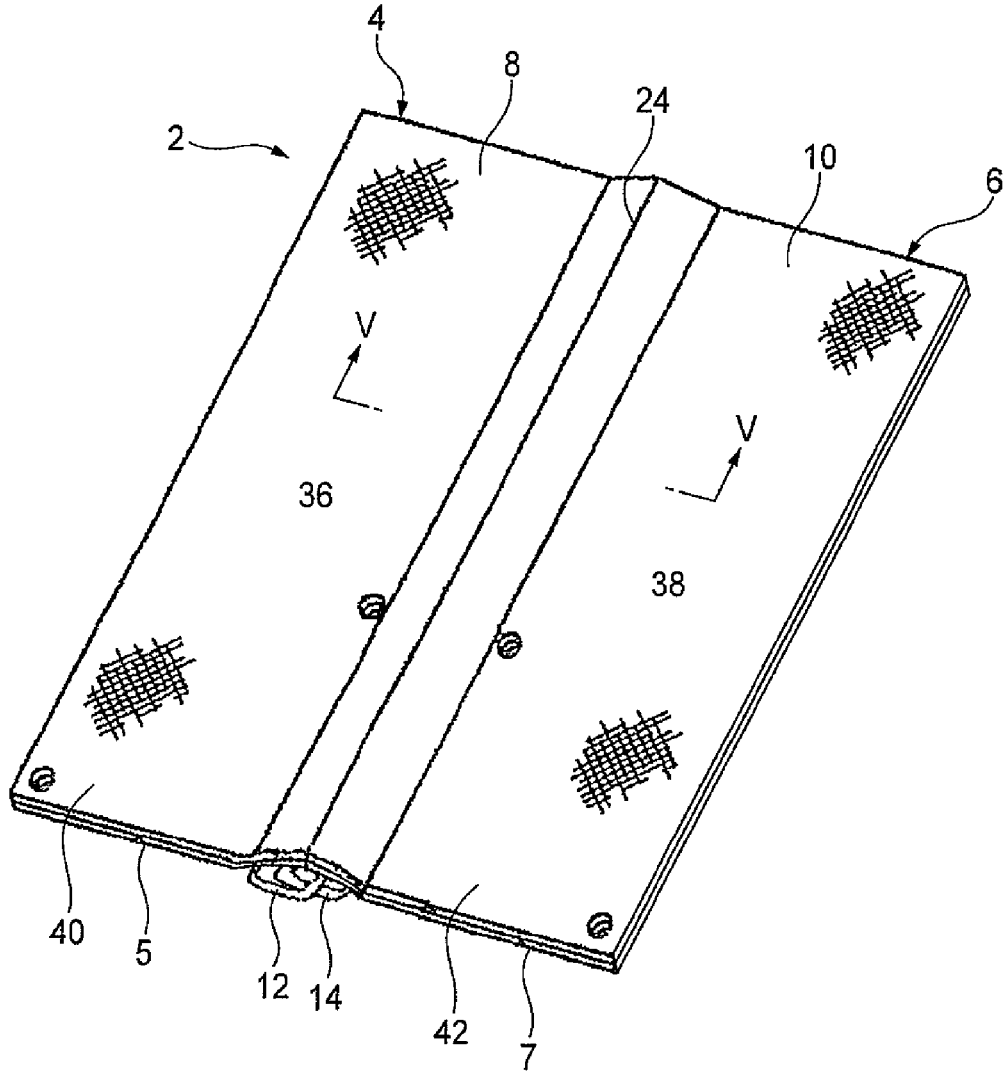
FIG. 5 shows a top view of an alternative slide fastener as in FIG. 1, before the step of moulding a bottom end stop in place.
Figure 6:
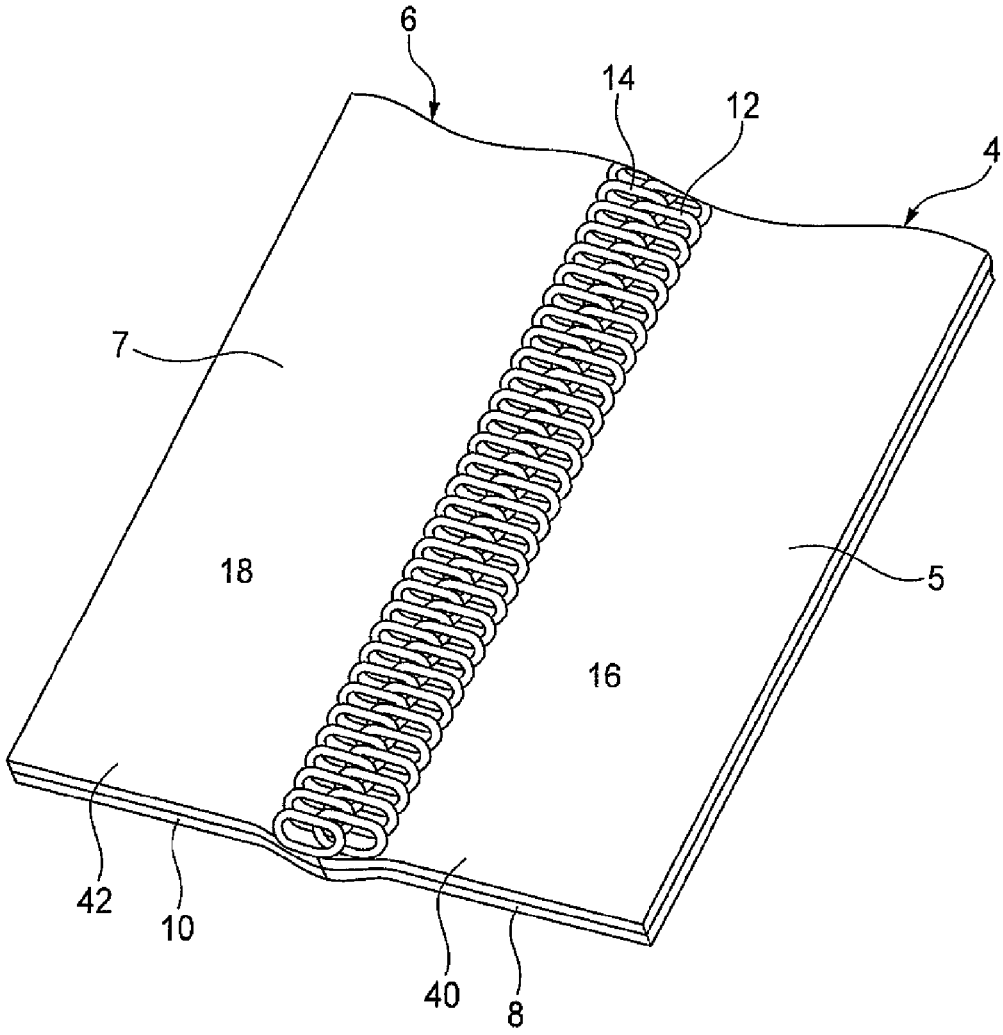
FIG. 6 shows an underneath view of the alternative slide fastener as in FIG. 2, before the step of moulding a bottom end stop in place.

In FIGS. 5 and 6, there is illustrated upper and lower surface portions of the slider fastener 2, respectively according to one aspect of the present invention before application of the end stop 26.

Figure 7:
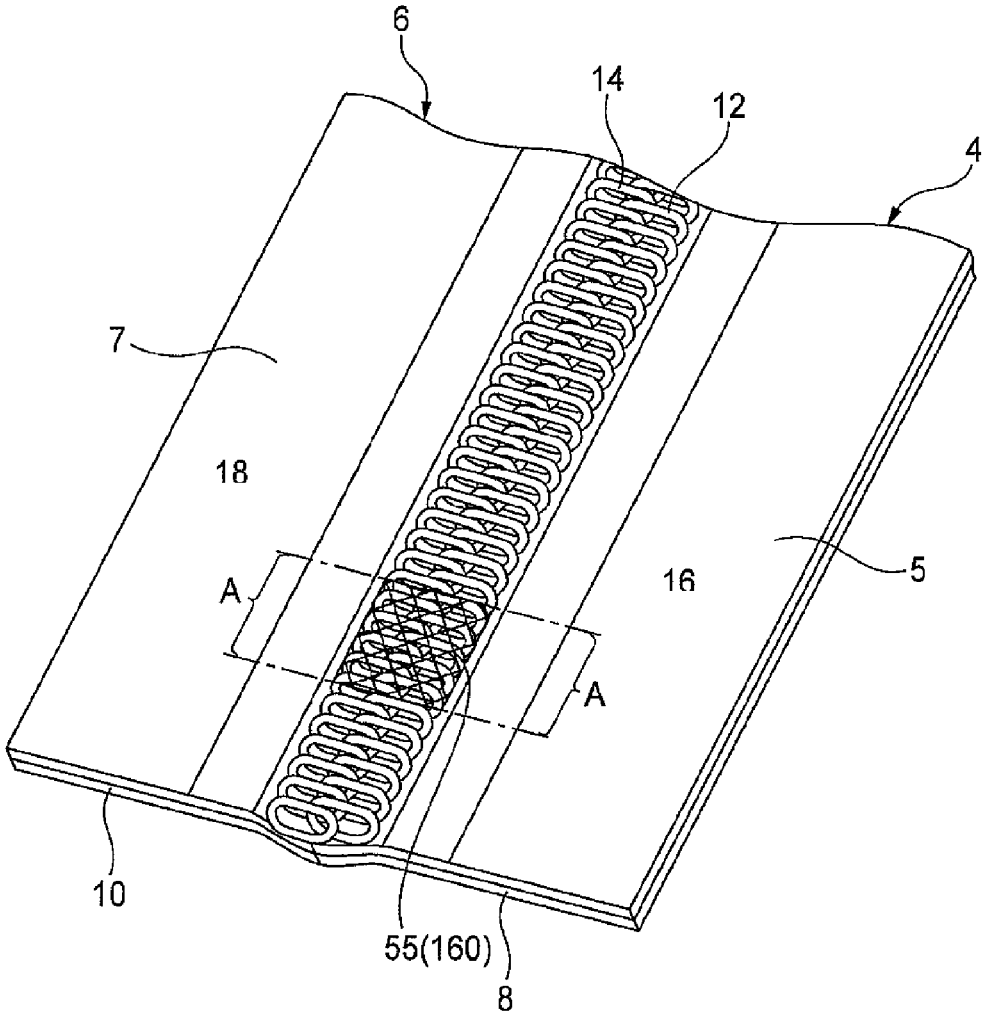
FIG. 7 shows an underneath view of a slide fastener with welded coupling elements denoted by region A.
Figure 9:
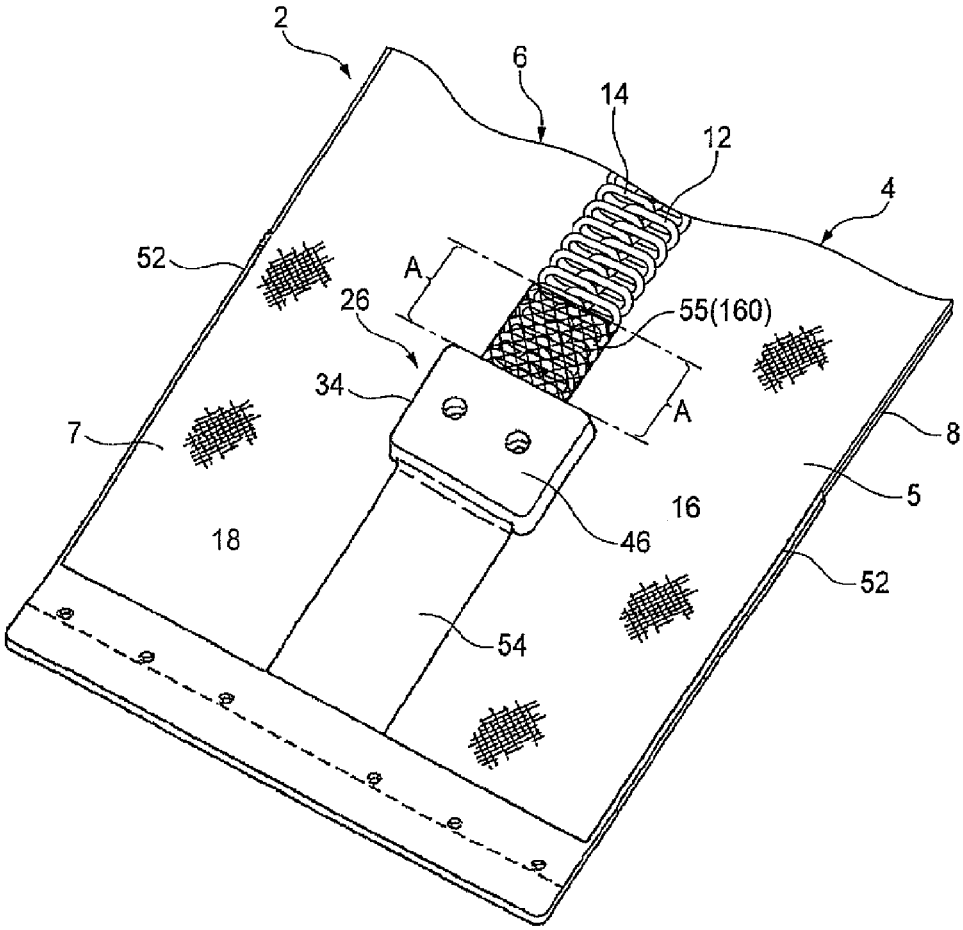
FIG. 9 shows an underneath view of the slide fastener of FIGS. 1 and 2 wherein a portion of the coupling elements has been welded together above the end stop.
Figure 10:
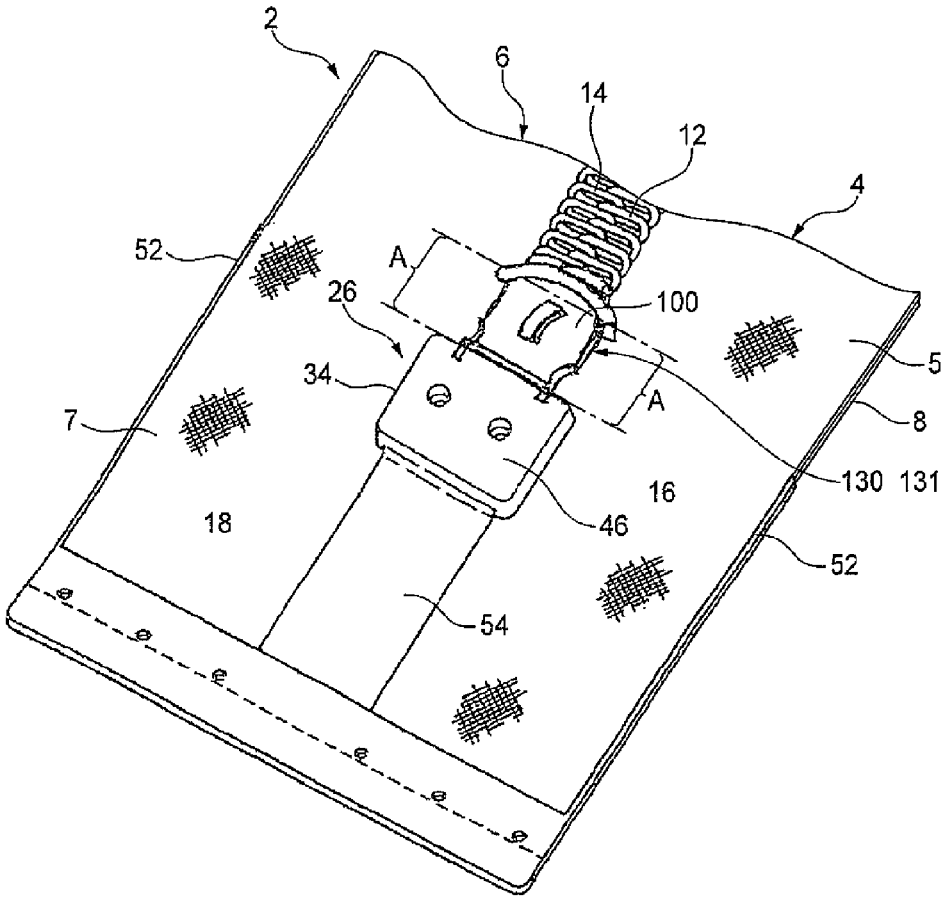
FIG. 10 shows an underneath view of a slide fastener with a slider resting in position over the welded coupling elements.

In FIGS. 7 and 9, there is illustrated the underneath view (a view illustrating a coupling element side) of a slide fastener according to the present invention with welded or fused coupling elements. The area on which the welded or fused coupling elements 12, 14 are secured is denoted by region A in FIGS. 7 and 9 and the area can be seen to extend away from the front most portion of the end stop 26 in FIG. 9 and along a length of the coupling elements 12, 14. It will be appreciated that if a simplified end stop is employed in the form of for example a metal clip, the welded or fused coupling elements 12, 14 would start directly after the clip. In this way the welded or fused coupling elements 12, 14 form an extended end stop 55. That is, an extension portion 55 (the extended end stop) which extends from the body portion 34 is formed so as to extend from the body portion 34 in a front (forward) direction of the slide fastener 2 (toward a side at which the coupling elements 12, 14 are formed). The extended end stop 55 is lower than the body portion 34 in height (thinner than the body portion 34 in thickness) and can be inserted into a gap between the upper and lower wings 100, 110 of the sliders 130, 131.

In accordance with the embodiment of the present invention, it will be apparent that the size of the joined (secured) region 'A' of the coupling elements 12, 14, which is secured by one or more of welding, sewing and/or injection moulding and hence forming the extended end stop 55, is required to be equivalent to the space denoted by region 'A' in FIG. 12. As shown in FIG. 12, the region in the slider 130, denoted by region 'A' extends from the base portion 140 (the bottom portion or the rear mouth) of the slider 130 to the rear end portion 150 of the diamond 120. In this joined region 'A', the coupling elements 12, 14 are secured integrally, i.e. inseparably from each other.

Consequently, as shown in FIG. 13, when the slider 131 is brought along the slide fastener 2 so that the base portion 140 of the slider 131 is level with (has the same thickness as) the start of the welded or fused coupling elements 160, the rear end 150 of the diamond 120 rests against a front end portion of the welded or fused coupling elements 160 (which may also be sewn together. The sewing is performed by sewing with a yarn the pair of coupling elements 12, 14 on each other to form sewn coupling elements 190). The height (thickness) of the coupling elements 160 means a dimension parallel with a front and rear direction of the fastener tapes 4, 6. The width of the coupling elements 160, as described later, means a dimension parallel with the fastener tapes 4, 6 and perpendicular to the front and rear direction of the fastener tapes 4, 6 and such a direction is also referred to as a width direction. That is, the degree of welding or fusing of the coupling elements 160 has to be to the same degree as the distance between the base portion 140 of the slider 130, 131 and the rear end portion 150 of the diamond 120 and hence both are denoted by region 'A'.

Therefore, the size of the fused or welded portion A of the coupling elements 160 needs to be of a sufficient size to allow the slider 130, 131 to pass onto the welded coupling elements 160 and be concealed by the slider 130, 131 when the base portion 140 of the slider 130, 131 abuts the front portion 180 of the end stop 26 (for example when the end stop 26 has been injection moulded on to the tapes 4, 6) such that no unfastenable coupling elements 12, 14 which are unintentially separated from each other are present behind the rear end portion 150 of the diamond 120 of the slider 130, 131. Consequently, when the slider 130, 131 is again drawn along the open coupling elements 12, 14 of the slide fastener 2, the open coupling elements 12, 14 will be reclosed leaving no coupling elements 12, 14 remaining open. In other words, even if the interdigitated coupling elements 12, 14 are unintentionally separated from each other, by moving the slider 130, 131 until it comes in contact with the end stop 26, the extended end stop 55 of the end stop 26 is inserted into the rear mouth of the slider 130, 131 and comes in contact with the rear end portion 150 of the diamond 120. Consequently, the separated coupling elements 12, 14 are positioned in front of the rear end portion 150 of the diamond 120, and only the extended end stop 55 which is fused or welded coupling elements 160 is exist behind the rear end portion 150 (that is, the slide fastener 2 goes into a normal state where the slide fastener 2 is normally opened to the end stop 26). Thus, by pulling the slider 130, 131 up again, the separated coupling elements 12, 14 are normally engaged with each other from the first one, no coupling elements 12, 14 is remained open between the slider 130, 131 and the end stop 26 and it is possible to interdigitate all of the coupling elements 12, 14 again.

Figure 11:
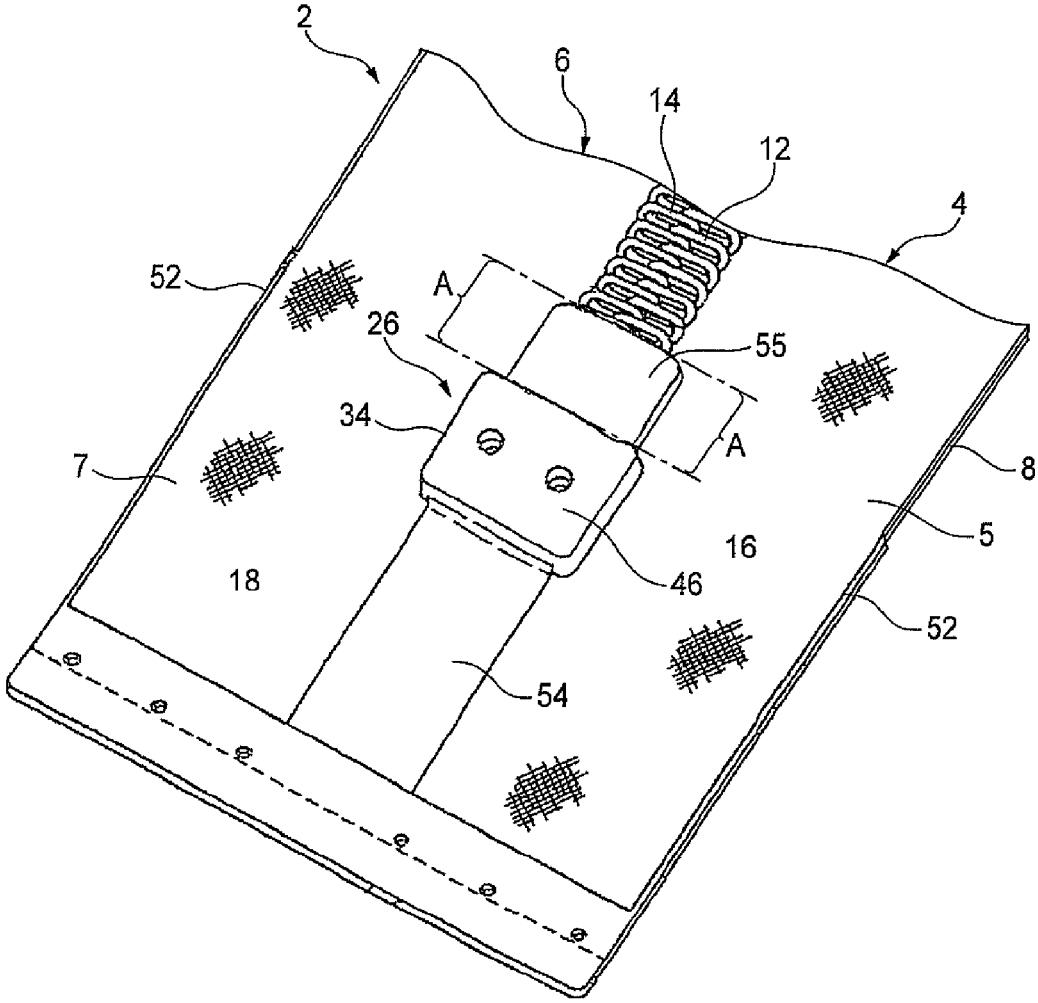
FIG. 11 shows an underneath view of a slide fastener with an end stop wherein a portion of the coupling elements have been secured together by means of an overlay of injection moulded plastic material.

Hence, according to the embodiments of the present invention, the area of the coupling elements denoted by region A can be welded or fused together to form an extended end stop denoted by 55 in FIG. 11, or alternatively and/or additionally the coupling elements may be injection moulded with the same material as that used to form a cob as shown in FIG. 11, to form an area which is doubly reinforced.

The fused coupling elements forming the extended end stop may also be used on a gapped chain so that when an injection moulded end stop in the form of a cob is further applied, the injection moulded cob abuts or partially overlaps the last of the fused coupling elements. The gapped chain is a chain having a gap between the cob and the last one of the coupling elements.

Whilst the extended end stop of the embodiments of the present invention denoted by region 'A', may be formed with or without additional sewing, and may be formed from one type of connection methods such as the fusing, the welding, the sewing and the injection moulding. For example, the coupling elements may be either fused by heating or welded using an injection moulding process. The area of the coupling elements denoted by region A may be formed with or without additional sewing and the area of the coupling elements denoted by region A may be formed firstly welded or fused by heat and then additionally overlaid by injection moulding. It is preferred to form an extended end stop which is strong and addresses the problems outlined above for the slide fasteners which has been unintentionally separated (opened).

Figure 8:
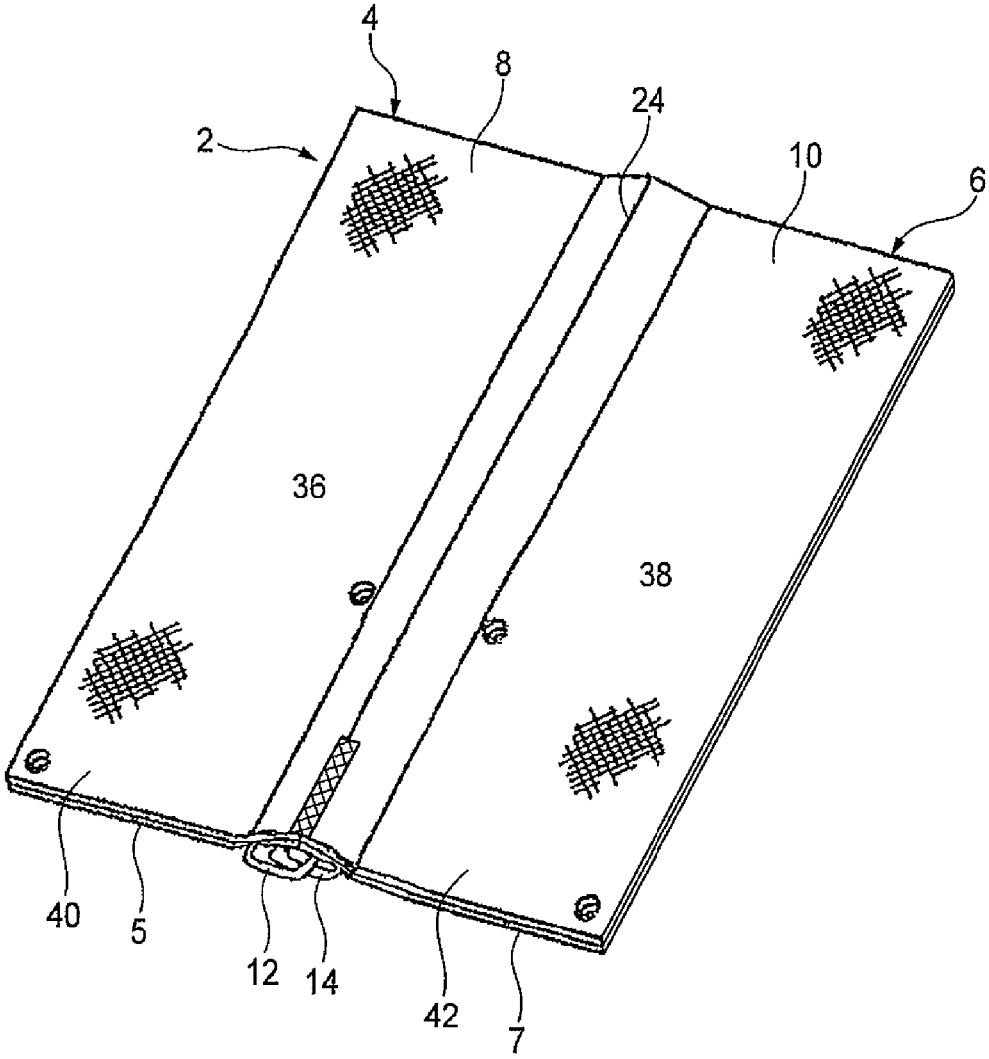
FIG. 8 shows a top view of the slide fastener as in FIG. 5 in which the sealing lips of the waterproof layer have been further welded.

Finally, when the top or upper-side of the tape layers 5, 7 of the slide fastener 2 is overlaid with the waterproof layers 8, 10 of thermoplastic elastomeric material, the extended end stop 55 may be further improved in terms of water fastness by melting and welding the sealing lips of the waterproof layers 8, 10 formed by the abutment of the waterproof layers 8, 10 at center line 24 as shown in FIG. 8 either before or after formation of the extended end stop 55.

Furthermore, as shown in FIGS. 1 and 2, the end stop 26 may be extended to form layers 52, 54 which extends over the upper surfaces 36, 38 of the waterproof layers 8, 10 or underneath surfaces 16, 18 of the tape layers 8, 7 and to the ends 40, 42 of the tapes 4, 6 as required.

Therefore the embodiments of the present invention solves the problems for slide fasteners with traditional end stops as outlined above by means of forming an elongated end stop, most preferably an elongated bottom end stop so that the coupling elements which might otherwise be left open in conventional slide fasteners through forced separation are fused or welded to be secured.

That is, by welding, fusing or injection moulding the coupling elements 12, 14 from the rear end portion 150 of the diamond 120 of the slider 130, 131 to the base portion 140 to form the extended end stop 55 in the bottom end stop 26 so that the slider 130, 131 will rest on this bottom end stop 55, even if the chain of the slide fastener 2 bursts fully open completely, there will be no coupling elements behind the rear end portion 150 of the diamond 120 of the slider 130, 131 remaining open and therefore no coupling elements 12, 14 that cannot be re-joined.

The slide fastener 2 and end stop 26 according to the embodiments of the present invention is prepared as follows.

First of all a stretch or portion of the coupling elements 12, 14 denoted by 'A' in FIGS. 7 and 9 are sewed and/or welded together, for example ultrasonically. This ensures that the coupling elements 12, 14 themselves cannot be pulled apart from each other and also provides a base portion (the welded coupling elements 160) from which the placement of the bottom end stop 26 can be calculated.

Secondly, when the slide fastener 2 is to be used as a sealing slide fastener, the sealing lips of the waterproof layers 8, 10 of the slide fastener 2 is heated and joined together. It will be appreciated by one skilled in the art that this step would not be necessary in a normal slide fastener or zip fastener as the seal for the plastic would not be there.

Thirdly, an end stop 26 is injection moulded onto the tape 4, 6 below the area of the welded coupling elements 160. Integrally with this, a plastic material is also over-moulded (moulded so as to cover the outer side of the welded portion) onto the welded portion of the coupling elements 160 and so form the completed extended end stop 55.

This additional moulding atop the welded or fused coupling elements 160 also strengthens the welded portion, and renders it more aesthetically pleasing. The additional moulding also assists in preventing the whole of the welded portion being pulled away from the slide fastener 2.

In a preferred embodiment of the present invention, in which a cob protrudes from the bottom end stop, the bottom portion (the base portion) of the slider may be brought to a stop against it and thereby prevent the diamond of the slider from excessively coming into contact with the over-moulded welded area which might over time be worn away and broken by being pulled into the over-moulded welded area. When there is no bottom end stop with the cob protruding beyond the width or height of the slider, there is always a danger that the slider could be pulled off the chain altogether with excessive force. The cob protrudes such that the thickness of the bottom end stop with the cob is thicker than the thickness of the engaged coupling elements. Further the cob is larger than the engaged coupling elements in the dimension in the width direction and protrudes toward the outer side of the coupling elements. The cob is a part of the body portion 34 and functions to abut the base portion of the slider to prevent the slider from coming off the fastener chain.

It will be appreciated that the cob and the over-moulded portion do not have to be integral and indeed either could be a metal clasp or similar. In the embodiments illustrated in the accompanying drawings, the coupling elements are the coil-shaped coupling elements. However, the present invention is not limited to the embodiments and suitable coupling elements used in a normal slide fastener may be used. For example, the coupling elements are injection-moulded onto the fastener tapes, or the coupling elements may be disposed on the fastener tapes and then be secured by the fusing or the welding.

The invention claimed is:

1. A slide fastener, comprising:

a pair of fastener tapes each comprising a tape layer;

a pair of coupling elements provided along adjacent edges of the pair of fastener tapes;

a slider that engages or separates the pair of coupling elements with or from each other; and an end stop secured to the pair of fastener tapes at an end portion of the pair of coupling elements, wherein the pair of coupling elements are integrally secured to each other at one region of the end portion of the pair of coupling elements, wherein the one region extends between a rear end portion of a diamond of the slider and a base portion of the slider in a state where the base portion of the slider comes in contact with the end stop, wherein the slide fastener is a waterproof slide fastener, wherein each of the tape layers comprises at least one waterproof layer, wherein the waterproof layers abut one another, wherein the abutting waterproof layers are further melted and welded, and wherein an extension portion of the end stop is formed where the abutting waterproof layers are melted and welded.

2. The slide fastener as claimed in claim 1, wherein the pair of coupling elements are secured by means of injection molding.

3. The slide fastener as claimed in claim 1, wherein the pair of coupling elements are secured by means of sewing.

4. The slide fastener as claimed in claim 1, wherein the pair of coupling elements are secured by means of welding or melting.

5. The slide fastener as claimed in claim 1, wherein the pair of fastener tapes and the pair of coupling elements are joined by an extension portion of the end stop between the adjacent edges of the pair of fastener tapes.

6. The slide fastener as claimed in claim 5, wherein the end stop is a closed end stop and is provided to cover the adjacent edges of the pair of fastener tapes.

7. The slide fastener as claimed in claim 1, wherein each of the pair of coupling elements are formed by a continuous coil.

8. The slide fastener as claimed in claim 1, wherein the end stop includes a body portion which is formed on a tape surface of at least one side of the pair of fastener tapes.

9. The slide fastener as claimed in claim 8, wherein the end stop protrudes toward an opposite side of the body portion with respect to the coupling elements and extends to an end portion of the fastener tapes.

10. The slide fastener as claimed in claim 1, wherein the end stop extends over an adjacent area of the waterproof layers.

11. The slide fastener as claimed in claim 1, wherein the end stop encapsulates one or more coupling elements.

12. The slide fastener as claimed in claim 1, wherein the end stop includes a cob protruding from the end stop in a direction of a chain of the coupling elements against which the base portion of the slider abuts.

* * * * *